US010723601B2

(12) United States Patent
Hall et al.

(10) Patent No.: US 10,723,601 B2
(45) Date of Patent: Jul. 28, 2020

(54) WINCH AND FAIRLEAD WITH A DETACHABLE LINE GUIDE

(71) Applicant: Hall Labs, LLC, Provo, UT (US)

(72) Inventors: David R. Hall, Provo, UT (US); Daniel Madsen, Vineyard, UT (US); Jerome Miles, Spanish Fork, UT (US); Corey Webb, Spanish Fork, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/233,103

(22) Filed: Dec. 27, 2018

(65) Prior Publication Data

US 2020/0207592 A1 Jul. 2, 2020

(51) Int. Cl.
*B66D 1/38* (2006.01)
*B66D 1/36* (2006.01)

(52) U.S. Cl.
CPC ..... *B66D 1/36* (2013.01); *B66D 1/38* (2013.01); *B66D 2700/0141* (2013.01); *B66D 2700/0191* (2013.01)

(58) Field of Classification Search
CPC ... B66D 1/36; B66D 1/38; B66D 1/40; B66D 1/46; B66D 1/48; B66D 1/485; B66D 1/50; B66D 1/505; B66D 2700/0191; B66D 2700/0141
See application file for complete search history.

(56) References Cited

U.S. PATENT DOCUMENTS

| | | | | |
|---|---|---|---|---|
| 2,396,958 | A * | 3/1946 | Mackmann | B66D 1/36 242/483.4 |
| 4,015,798 | A * | 4/1977 | Benya | B66D 1/38 242/157.1 |
| 4,235,394 | A * | 11/1980 | Fry | B65H 54/2854 242/397.3 |
| 4,455,961 | A * | 6/1984 | Hansen | B66D 1/38 114/242 |
| 6,811,112 | B1 * | 11/2004 | Currie | B65H 54/2872 242/157.1 |
| 9,248,999 | B2 * | 2/2016 | Xydias | B66D 1/38 |
| 9,783,399 | B2 * | 10/2017 | Hausladen | B66D 1/30 |
| 10,093,522 | B1 * | 10/2018 | Baugh | B66D 1/36 |
| 10,294,087 | B2 * | 5/2019 | Hall | B66D 1/38 |
| 10,544,017 | B2 * | 1/2020 | Hall | B66D 1/365 |
| 2005/0087644 | A1 * | 4/2005 | Kim | B65H 75/425 242/390.8 |
| 2008/0246011 | A1 * | 10/2008 | Heravi | B66D 1/14 254/266 |
| 2009/0242861 | A1 * | 10/2009 | Kochan | B66D 1/14 254/293 |
| 2015/0266707 | A1 * | 9/2015 | Holmberg | B66D 1/12 254/362 |
| 2019/0263641 | A1 * | 8/2019 | Hall | B66D 1/38 |

* cited by examiner

*Primary Examiner* — Michael E Gallion

(57) ABSTRACT

A fairlead for use with a winch is disclosed. The fairlead includes: a self-reversing screw; a motor for driving the self-reversing screw; and a guide comprising a guide nut and a first guide side and a second guide side. The guide is driven by the self-reversing screw. As a line is coiled onto a winch drum the guide directs the line onto the winch drum. The first guide side and second guide side are detachable from the guide nut and from each other.

20 Claims, 9 Drawing Sheets

WINCH AND FAIRLEAD WITH A DETACHABLE LINE GUIDE

CROSS-REFERENCE TO RELATED APPLICATIONS

This application is a continuation-in-part of U.S. Provisional Application 62/635,659 filed Feb. 27, 2018, the entire contents of which are incorporated by reference.

TECHNICAL FIELD

The invention relates to winches and fairleads for winches.

BACKGROUND

Winches are valuable tools. Winches help get people unstuck or lift loads. A winch winds a line around a drum. Typically, winches have little to no management of how the cable winds on the drum. Most interaction with the winch cable is traditionally done by hand. On a traditional winch, a user will generally need to disengage the winch drum from the winch gearbox by pulling a lever and entering a "free-spool" mode. A user will then pull the line to unspool the cable from the winch drum by hand.

If a user were to try and unspool the line by pushing the out button, the drum would spin, without the line coming off the drum. Instead, the line would begin to loosen on the drum and become a tangled mess.

Guiding the line back onto the winch drum of traditional winches is also done by hand. If the line is not coiled in an organized even way, with no gaps between the coils of line, the line may not fit on the drum. Additionally, without organized even coiling the line is likely to become tangled the next time it is unspooled. It can be dangerous to guide the line onto the winch drum by hand because debris can get caught in the line and cause damage to a user's hand.

A winch can be damaged when it is overloaded. An overloaded winch will often create excessive heat which can damage the motor, gearbox or winch line. This can then lead to the winch line snapping, thus causing damage to the vehicle the winch is attached to as well as surrounding people.

SUMMARY

In a first aspect, the disclosure provides a fairlead for use with a winch. The fairlead includes: a self-reversing screw; a motor for driving the self-reversing screw; and a guide comprising a guide nut and a first guide side and a second guide side. The guide is driven by the self-reversing screw. As a line is spooled onto a winch drum the guide directs the line onto the winch drum. The first guide side and second guide side are detachable from the guide nut and from each other.

In a second aspect, the disclosure provides a fairlead for use with a winch. The fairlead includes: a first and second roller adapted to aid in spooling or unspooling a line; a self-reversing screw; a motor for driving the self-reversing screw and at least the first roller; a sensor for determining a load on a winch and whether a winch drum is spooling or unspooling a line; a device to measure the current drawn by the motor; a controller connected to the motor and in communication with the sensor and the device; multiple lights in an array, each of which can be changed by the controller from one appearance to another; and a guide comprising a guide nut and a first guide side and a second guide side. The sensor determines whether the winch drum is spooling or unspooling the line. The controller is configured to direct the motor so that at least the first roller assists in spooling or unspooling the line in coordination with the winch drum. In response to a signal from the sensor, the controller is configured to change the appearance of lights in the array, with the number of lights with a changed appearance being proportional to the load sensed by the sensor. The controller is configured to direct the fairlead motor to drive at least the first roller so that the fairlead motor maintains a target current draw. The guide is driven by the self-reversing screw. As a line is spooled onto a winch drum the guide directs the line onto the winch drum. The first guide side and second guide side are detachable from the guide nut and from each other.

In a third aspect the disclosure provides a winch. The winch includes a winch motor, a winch drum for spooling and unspooling a line, and a fairlead. The fairlead includes: a first and second roller adapted to aid in spooling or unspooling a line; a self-reversing screw; a motor for driving the self-reversing screw and at least the first roller; a sensor for determining a load on a winch and whether a winch drum is spooling or unspooling a line; a device to measure the current drawn by the motor; a controller connected to the motor and in communication with the sensor and the device; multiple lights in an array, each of which can be changed by the controller from one appearance to another; and a guide comprising a guide nut and a first guide side and a second guide side. The sensor determines whether the winch drum is spooling or unspooling the line. The controller is configured to direct the motor so that at least the first roller assists in spooling or unspooling the line in coordination with the winch drum. In response to a signal from the sensor, the controller is configured to change the appearance of lights in the array, with the number of lights with a changed appearance being proportional to the load sensed by the sensor. The controller is configured to direct the fairlead motor to drive at least the first roller so that the fairlead motor maintains a target current draw. The guide is driven by the self-reversing screw. As a line is spooled onto a winch drum the guide directs the line onto the winch drum. The first guide side and second guide side are detachable from the guide nut and from each other.

Further aspects and embodiments are provided in the foregoing drawings, detailed description, and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
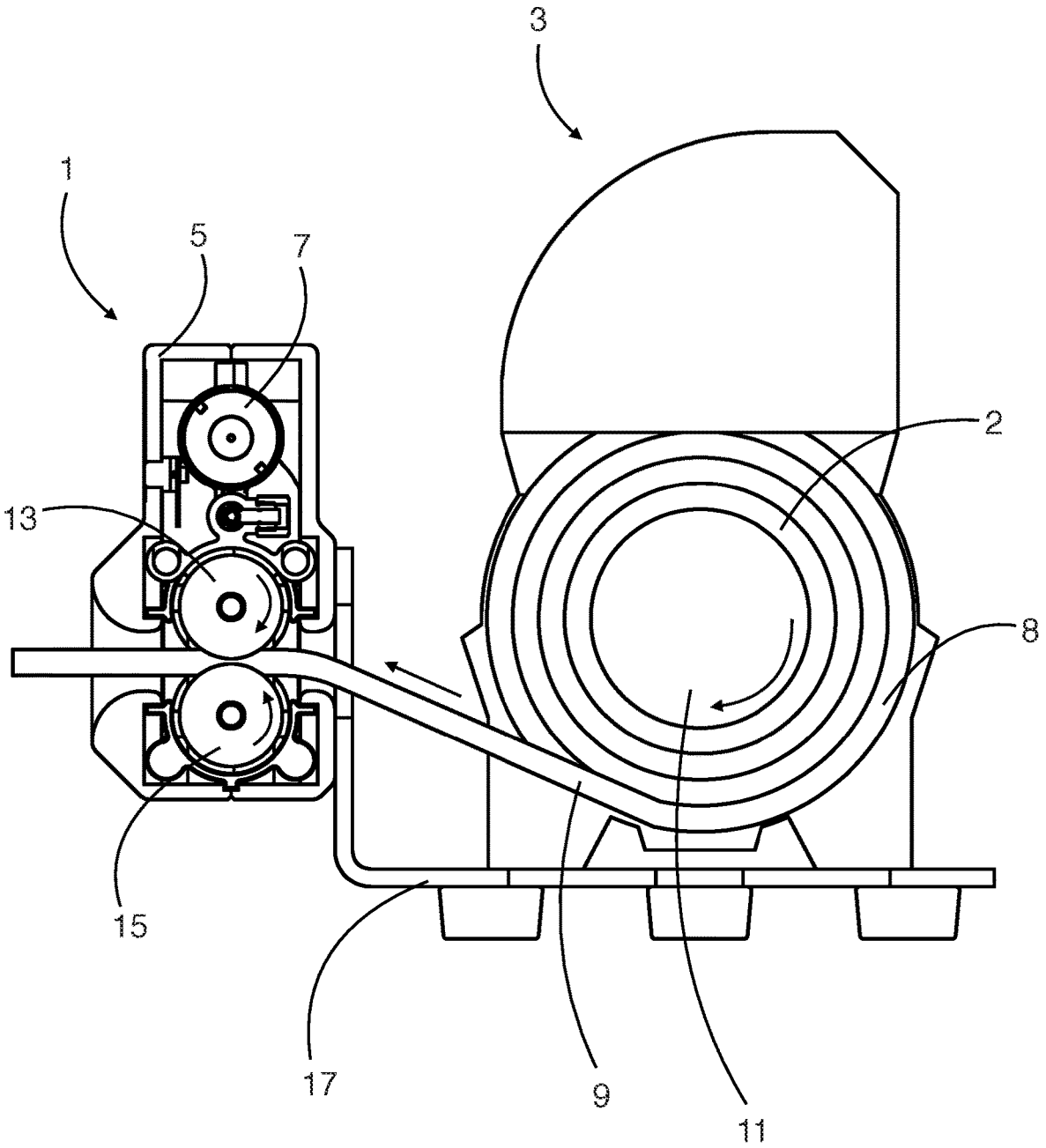
FIG. 1 is a cross-section of the fairlead attached to a winch.

The following description recites various aspects and embodiments of the inventions disclosed herein. No particular embodiment is intended to define the scope of the invention. Rather, the embodiments provide non-limiting examples of various compositions and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "remote-control device" is meant to refer to remote-control devices specific to the fairlead and winch, smartphones, tablet computing devices, and laptop computers.

As technology has advanced, improvements in motors and composites have led to advances in winch technology. While improvements have taken place, older technologies are still in use and less expensive models continue to use the older technology. In the area of winches, older less expensive winches use a DC motor that would currently be thought of as basic. This basic DC motor uses permanent magnets. The change in direction of the motor and thus the drum, to spool the cable onto the drum or unspool the cable from the drum, is accomplished by changing the electrical polarity applied to the motor. Effectively, for example, what was a positive voltage for a clockwise rotation to unspool a cable from the drum would then become a negative voltage for a counter-clockwise rotation to spool a cable onto the drum.

The newest high-powered winches utilize a series-wound motor to turn the winch drum. Series-wound motors offer higher start-up torques and do not require permanent magnets. In a series-wound motor, a current will run through the armature on the shaft of the motor (as happens with a basic DC motor) and will also run through windings on the motor stator. The windings are electrical wires (typically copper wire) wound around the motor stator. By running a current through the windings magnetic fields are created. The direction of the current through the windings determines the polarity of the magnetic field. Though the electrical polarity does not change, the current pathway does. A current sensing device is placed to know the direction of the current which leads to knowing the rotational direction of the drum.

This same current sensing device will also work with the basic permanent magnet motor. The change in polarity of a basic permanent magnet motor is effectively a change in the direction of the current.

An alternative to hand guiding a cable off the winch drum is to use a powered fairlead. The powered fairlead also has a line guide to direct the cable spooling and unspooling. It is important to know the direction of rotation of the winch drum so that the fairlead is working with the winch to spool and unspool the line. It would be against the purpose of the fairlead if the rollers of the fairlead were trying to unspool the cable from the drum while the winch was trying to spool the cable onto the drum.

When unspooling the cable from the drum, the fairlead motor must rotate in the correct direction to rotate the rollers and actively pull the cable out and away from the winch drum. The rollers of the fairlead are made of foam or rubber. The line is compressed between the two rollers as it is unspooled and spooled. The material of the rollers and the compression created on the line assist in gripping the line as it is unspooled.

It is important that the line coil onto the winch drum in an organized and even manner. The fairlead helps to accomplish this by integrating an automatic line coiling mechanism into the fairlead.

When spooling the cable onto the drum, the fairlead motor needs to rotate in the opposite direction to assist the winch drum in spooling the cable onto the drum.

Now referring to FIG. 1, which is a cross-section of the fairlead 1 and the winch 3. The winch 3 and fairlead 1 are both attached to a frame 17. The fairlead housing 5 attaches the fairlead 1 to the frame 17. The winch 3 has a drum 11 around which a line 11 is coiled. When the drum 11 rotates to unspool the line 9 as seen by the arrow on the drum indicating the direction of rotation. The arrows indicate the direction the line 9 is moving. As the line 9 is unspooled from the drum 11, it passes between the upper roller 13 and the lower roller 15 of the fairlead 1. The rollers are designed so that they assist in unspooling the line. The fairlead 1 has a motor which rotates the rollers to assist the line 9 as it unspools from the drum 11 of the winch 3.

To ensure that the rollers 13 and 15 of the fairlead 1 are assisting to unspool the line off the winch, the motor 7 of the fairlead 1 must turn the rollers so that they are unspooling the line 9 in concert with the winch drum 11. The arrow on winch drum 11 indicates the direction of rotation, for the purposes of this example the winch drum 11 is moving in a clockwise direction to unspool the line 9 from the winch drum. The line 9 is unspooling from the drum 11 and moving toward the fairlead 1. The upper roller 13 and lower roller 15 are preferably composed of a material that is compressible and grippy on the surface. The line 9 is also preferably composed of a compressible material or constructed in a manner that enables compression. As the rollers 13 and 15 unspool the line 9, both the line 9 and the rollers 13 and 15 compress which grips the line 9, therefore enabling tension on the line 9 so that it unspools smoothly. To ensure that the line 9 unspools smoothly the rollers 13 and 15 must rotate in the correct direction. The motor 7 of the fairlead 1 is connected to a microcontroller which is connected to a sensor placed in the winch (shown in FIG. 3) to determine the direction of rotation of the winch drum 11. The sensor will be described later. The sensor communicates the direction of rotation of the winch drum 11 to the fairlead motor 7. This enables the fairlead motor 7 to rotate the rollers 13 and 15 in the correct direction to unspool the line. In the present example, the upper roller 13 rotates in a clockwise direction, as shown by the arrow on upper roller 13. At the same time, the lower roller 15 rotates in a counterclockwise direction, as shown by the arrow on the lower roller 15. The rotation of the rollers 13 and 15 keep tension on the line 9 as it is unspooled from the winch drum 11.

The upper roller 13 and lower roller 15 are preferably made of foam or rubber. In other embodiments, the rollers are made of metal. The line 9 is compressed between the upper roller 13 and the lower roller 15 in some embodiments. In other embodiments, the material of the rollers 13 and 15 compresses, the line 9 also compresses which assists in gripping the line 9 to keep tension on the line 9 as it unspools. It is necessary to coordinate the speed at which the rollers 13 and 15 are turning with the speed at which the winch drum 11 is unspooling the line 9 from the drum. If the fairlead rollers 13 and 15 spin slower than the winch drum 11 is unspooling the line 9, the line 9 will become loose and tangled. If the fairlead rollers 13 and 15 spin faster than the winch drum 11 is unspooling the line 9, friction is generated between the rollers 13 and 15 and the line 9. Friction leads to excessive wear and stress on the fairlead rollers, gears, and motor.

The optimal speed for the rollers 13 and 15 to spin should be fast enough to maintain tension on the line 9 between the winch drum 11 and the rollers 13 and 15, but not so fast that unnecessary friction is generated. The ideal unspooling rope tension can be found when the fairlead overdrives the line 9. This means that the surface speed of the rollers 13 and 15 ($s_f$) is faster than the surface speed of the winch line ($s_w$) coming off the drum. This speed can be from 10% to 300% faster. This speed is preferably from 10%-100% faster. The roller rpm cannot be fixed at one constant speed throughout the entire unspooling process. This is due to how the winch line coils up on the drum in multiple layers. The outermost layer of the line ($r_4$) 8 will have a much faster surface speed than the innermost layer of the line ($r_1$) 2 since the winch drum rpm ($rpm_w$) is constant. This means that the fairlead rollers must spin fastest at the outermost layer and sequentially slow down as it reaches the innermost layer.

To maintain tension on the line during unspooling, the rpm of the roller changes as the line is unspooled. For many winches, the rpm of the winch drum does not change. However, the speed at which the line spools or unspools will change because as the line coils it increases the effective radius of the winch drum. When there is more line on the drum the speed at which the line spools or unspools will increase. As the line unspools from the drum the speed at which the line moves will decrease, as the line unspools from the drum and the effective radius of the drum decreases. As the line spools onto the drum the speed at which the line moves will increase, as the line spools onto the drum and increases the effective radius of the winch drum. The rollers need to rotate at a speed that maintains tension on the line. The roller speed will therefore not remain constant throughout the unspooling and spooling processes.

Mathematically the speed of the line at the roller will be $S_f=2\pi_{R0}(rpm_f)$. To maintain tension on the line this speed needs to be slightly faster than the speed of the line as it is coming off the winch drum. The speed of the line coming off the winch drum will change. For example, when the line is fully wound on the drum the effective radius is larger ($r_4$) 8. Therefore, the speed of the line will be faster $S_w=2\pi R_4(rpm_w)$. As the line unspools the effective radius of the winch drum decreases ($r_1$) 2. Therefore, the speed of the line will be slower $S_w=2\pi R_1(rpm_w)$.

It is difficult to know which wrap is being unspooled and at what point in time. A solution to change the roller speed at the correct time is accomplished through sensing the current draw of the fairlead motor 7. The current drawn by the motor is directly related to the tension on the line. The higher the tension the more current is drawn. To minimize wear on the fairlead, motor the tension should be as low as possible while still assisting the line in unspooling from the winch drum. Therefore, the fairlead motor is rotated so that the current drawn rotates the rollers to maintain the proper tension. When unspooling, a target current draw must be maintained throughout the entire process by changing the rpm of the fairlead motor 7. To maintain a consistent current, draw the microcontroller changes the speed at which the fairlead motor is rotating. A continuously monitors the current drawn by the fairlead motor. This sensor is separate from the sensor that monitors the direction and load of the winch. If the measured current is higher than the target current, this means too much friction is being created between the rollers 13 and 15 and the line 9. In such situations, the fairlead motor 7 needs to be slowed down. If the measured current is lower than the target current, this means the line 9 is most likely not in tension. In this instance, the fairlead motor 7 needs to speed up. The target current for the system is 3-4 amps.

Under most conditions the established target current draw will maintain adequate tension on the line. However, under some conditions it would be beneficial for the user to change the settings for the fairlead to assist in unspooling the line. In some embodiments, the fairlead communicates with and is controlled by a remote-control device (see FIG. 10). The remote-control device is adapted to allow the user to control the fairlead. In conditions where it would be beneficial for the user to change the settings, the user accesses the controls on the remote-control device. The remote-control device allows the user to increase or decrease the target current drawn by the fairlead motor. By changing the target current drawn by the fairlead motor the speed of the rollers will be changed. Further, by changing the speed of the rollers the tension on the line will be changed. For example, in extremely cold conditions the compressibility of the material of the rollers and the compressibility of the material of the line could change. This change in compressibility would change the grip the rollers have on the line. To compensate for the changes, the user could adjust the target current draw.

Currently, the target current draw for consistent current drawn by the fairlead motor is determined experimentally. A winch is unspooled and a fairlead with a preprogrammed current draw is used, tension on the line is checked. The minimum current draw to maintain the minimum tension necessary is then used as the target current.

Figure 2:
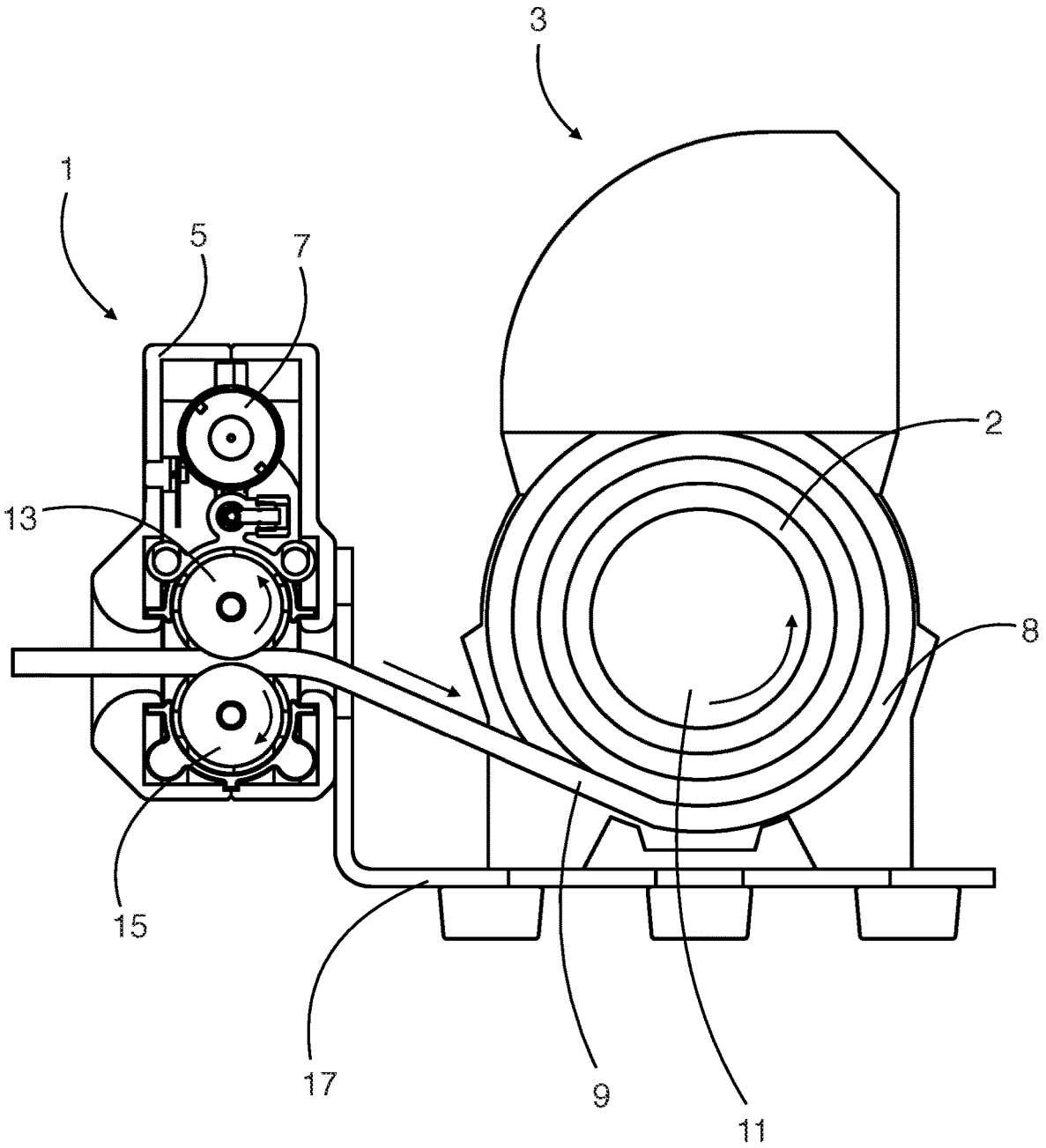
FIG. 2 is a cross-section of the fairlead attached to the winch.

As the winch drum 11 reverses direction, the line 9 is spooled onto the winch drum 11 as shown in FIG. 2. The winch 3 and fairlead 1 are both attached to a frame 17. The fairlead housing 5 attaches the fairlead 1 to the frame 17. The winch 3 has a drum 9 around which a line 11 is coiled. When the drum 11 rotates to spool the line 9 as seen by the arrow on the drum indicating the direction of rotation. The line 9 also has arrows to indicate the direction the line 9 is moving. As the line 9 is spooled onto the drum 11, it passes between the upper roller 13 and the lower roller 15 of the fairlead 1. The rollers are designed so that in some embodiments they assist in spooling the line. The fairlead 1 has a motor 7 which rotates the rollers to assist the line 9 as it spools onto the drum 11 of the winch 3.

To ensure that the rollers 13 and 15 of the fairlead 1 are assisting to spool the line onto the winch drum 11, the motor 7 of the fairlead 1 must turn the rollers so that they are spooling the line 9 in concert with the winch drum 11. The arrow on winch drum 11 indicates the direction of rotation, for the purposes of this example the winch drum 11 is moving in a counterclockwise direction to spool the line 9 onto the winch drum. The line 9 is spooling onto the drum 11 and moving away from the fairlead 1. The upper roller 13 and lower roller 15 compress the line 9. As the rollers 13 and 15 compress the line 9, they are able to keep tension on the line 9 so that it spools smoothly. To ensure that the line 9 spools smoothly the rollers 13 and 15 must rotate in the correct direction. The motor 7 of the fairlead 1 is connected to a microcontroller (not shown) which is connected to a sensor placed in the winch (not shown) to determine the direction of rotation of the winch drum 11. The sensor will be described later. The sensor communicates the direction of rotation of the winch drum 11 to the fairlead motor 7. This enables the fairlead motor 7 to rotate the rollers 13 and 15 in the correct direction to spool the line. In the present example, the upper roller 13 rotates in a counterclockwise direction, as shown by the arrow on upper roller 13. At the same time, the lower roller 15 rotates in a clockwise direction, as shown by the arrow on the lower roller 15. The rotation of the rollers 13 and 15 keep tension on the line 9 as it is spooled onto the winch drum 11.

When first used, the fairlead is preferably calibrated to the winch with which it is used. The winch line is spooled all the way out. The fairlead is then placed in a calibration mode. The line is spooled in for the full length of the line. The internal tachometer (shown in FIG. 3) logs the rpm of the fairlead rollers 13 and 15. During calibration, the rollers freely rotate, and the tachometer data can be directly related to the speed of the line. An algorithm then uses this data to assign the fairlead motor a permanent "spooling speed" that it will record to memory and use every time the line is spooled in. Factors that make up the algorithm include the roller tachometer data, roller diameter, the self-reversing screw pitch, gear reductions, and rope diameter. In addition to recording a fairlead motor speed variable, a "spool-down" variable will be measured and recorded as well. This variable relates to how long it takes the winch drum to come to a stop after the winch remote button is released. The fairlead needs to operate during this period so that the winch line is being managed during the spool-down time.

In some embodiments, the rollers disengage when rotating in the spooling direction due to a one-way bearing. Even when disengaged the rollers still maintain the tension on the line so as to enable the line to be spooled onto the winch drum in an even and organized manner.

Figure 3:
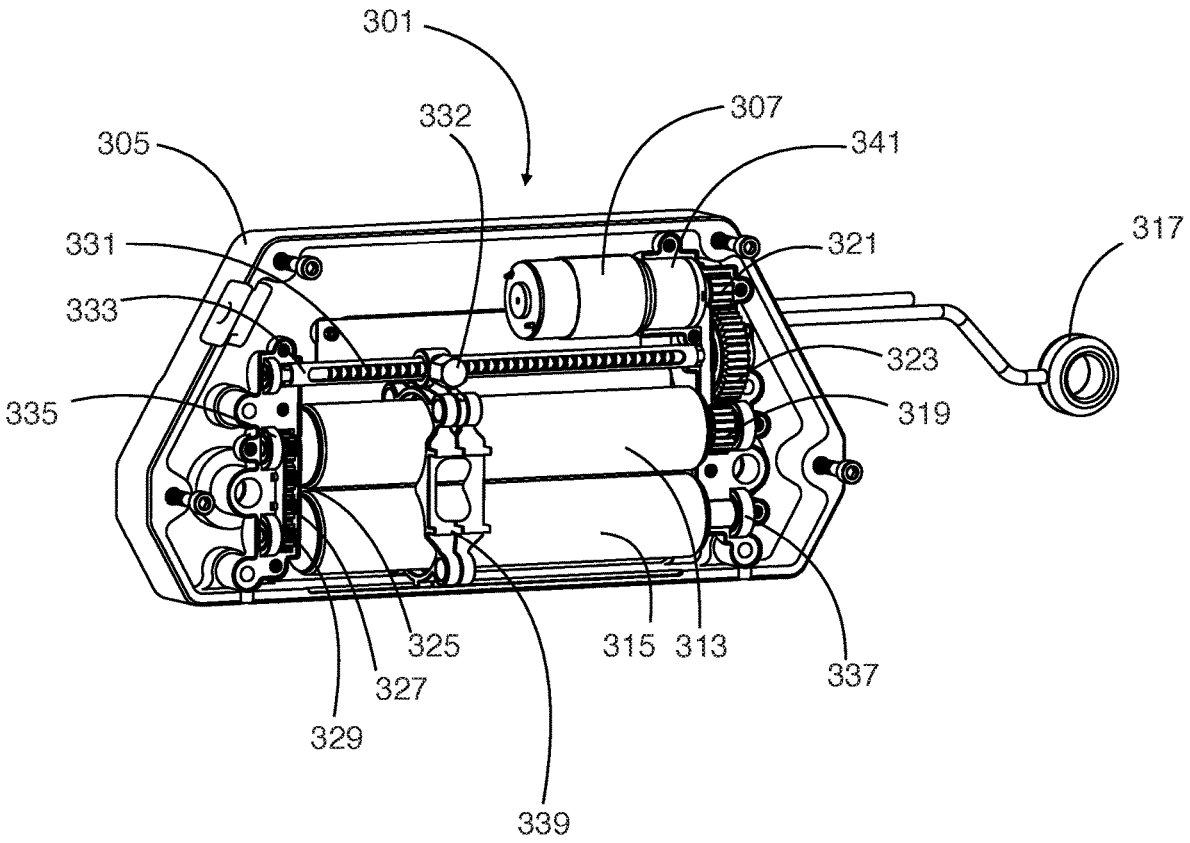
FIG. 3 is an internal view of the fairlead.

FIG. 3 is a view of the internal workings of the fairlead. The fairlead 301 integrates an automatic line coiling mechanism into the fairlead. The automatic coiling mechanism is directly geared to the fairlead motor 307. The winch line passes through the opening of the guide 339. The guide 339 directs the line as it spools onto the winch drum, to ensure organized even coiling of the line on the drum. The guide 339 travels across the winch parallel to the axis of rotation of the drum. The guide 339 is moved by the self-reversing screw 331, which is turned by the gears 323 and 327 connected to the fairlead motor 307. As the motor 307 speeds up, the guide 339 will be moved faster. The self-reversing screw 331 enables the guide to move back and forth across the width of the rollers 313 and 315. A guide nut 332 is attached to the guide 339 and threaded on the self-reversing screw 331. The self-reversing screw is within guide rod 333. As the line reaches one end of the winch drum, the self-reversing screw 331 will cause the guide 339 to reverse direction and coil the line over the line coiled on the winch drum. In this way, the line will be evenly coiled onto the winch drum.

The optimal function of the guide 339 occurs when the line is directly in front of the winch. There are times when it will be necessary to spool the winch when the line is pulling from a direction that is not directly in front of the winch. The guide 339 is beneficial in ensuring that the line coils evenly. However, when the line is spooling in from the side, the force on the guide 339 is increased.

Figure 4:
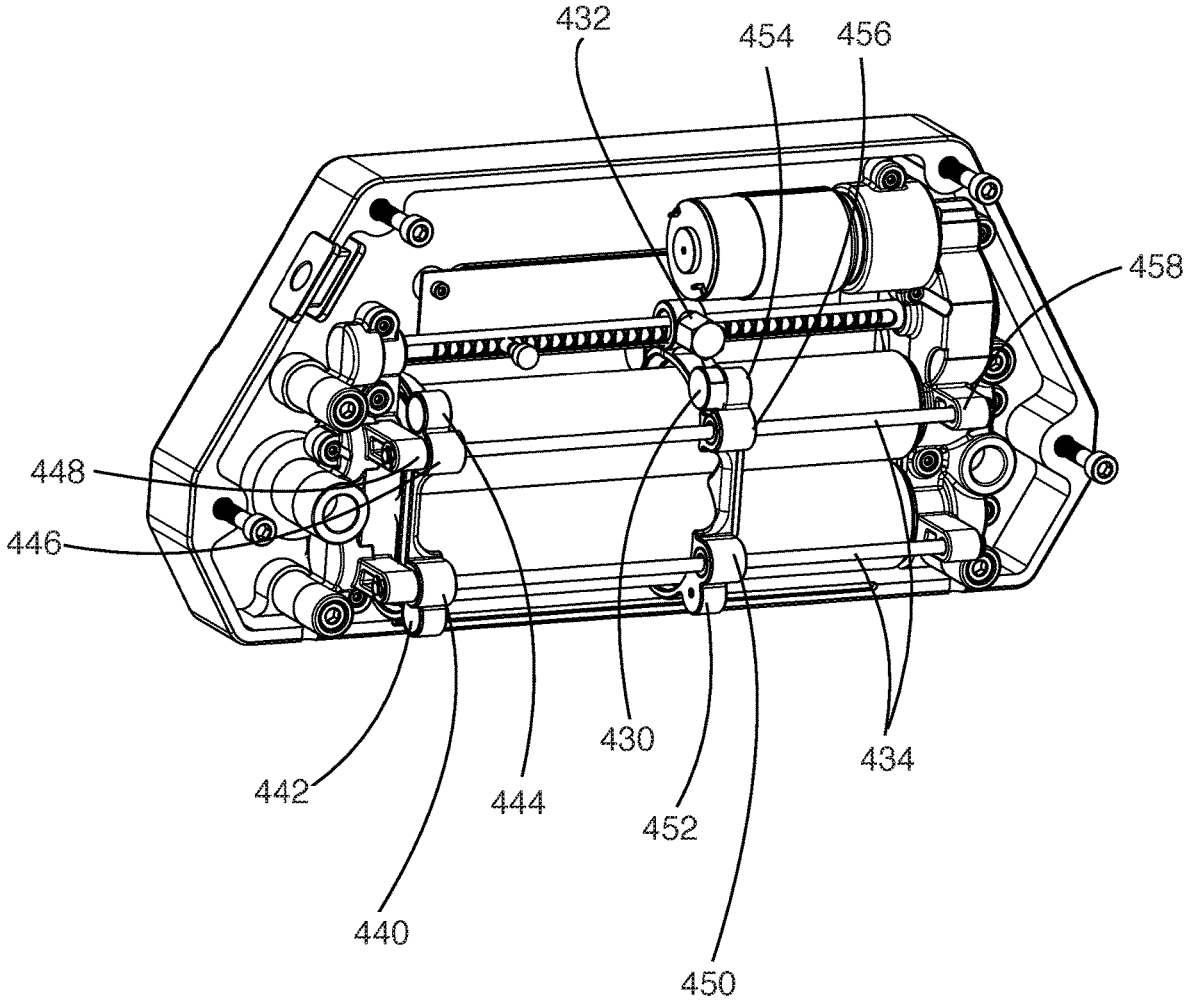
FIG. 4 is a perspective view of the fairlead guide.

Turning to FIG. 4 which shows how the guide is adapted to deal with tension on the line, when the tension is from a direction that is not directly in front of the winch, such as from the side. This tension on the line will create a lateral force on the guide. The guide includes three parts; two halves 440 and 450, and the guide nut 432. The guide nut 432 includes magnet 430 that holds the guide nut and two halves together. Guide half 440, the first guide side, contains a magnet 444 that connects to the magnet 430 in the guide nut 432. Guide half 450, the second guide side, contains a magnet 454 that connects to the magnet 430 in the guide nut 432. Guide half 440 has another magnet 442 that connects to magnet 452 in guide half 450. This magnetic assembly allows the guide to automatically disassemble upon rising tension in the line. This disassembly occurs when the tension in the line creates a lateral force on the guide. When the force pulling against the guide reaches a certain threshold, the side of the guide that is loaded will detach from the guide nut. This is illustrated in FIG. 4 by guide half 440 being detached from the guide nut 432 and the other guide half 450. It will then move along the support rails 434 until it reaches the end of the support rails. The detachment threshold is determined by the strength of the magnetic force between the guide sides and the guide nut. The detachment threshold is between 5 and 50 lbs. Preferably, the detachment threshold is between 5 and 35 lbs. Most preferably, the detachment threshold is between 5 and 20 lbs.

Continuing with FIG. 4. The winch line spools onto the drum in such a way as to put tension on guide half 440. This generally occurs when the winch is spooling in the line, and the line is spooling in from one side. As the line spools from the side, lateral force is applied to guide half 440, which causes guide half 440 to detach from guide nut 432 and guide half 450. Guide half 440 moves along the support rails 434 until reaching the end of the support rails. At the end of the support rails magnet 446 in guide half 440, connects with magnet 448. By connecting magnet 446 in guide half 440 to magnet 448 guide half 440 is kept out of the way of the line as it is spooling. When there is no more side tension on the line, guide half 440 will reconnect to the guide nut 432 and guide half 450. The attraction between magnets in guide nut 432 and guide halves 440 and 450 is stronger than the attraction between magnets 448 and 446.

The fairlead is enclosed by a housing 305. The housing is preferably made of metal. In some embodiments the metal is aluminum. In other embodiments, the housing is made from steel. Alternatively, the housing can be made from plastic.

It is important to note that in some embodiments the fairlead motor does not control the rollers while spooling due to the one-way bearing 319 that disengages them in the spooling direction. This allows the rollers 313 and 315 to spin while spooling. The material of the rollers and the bearing 319 maintain friction on the line, which keeps the tension between the fairlead and the winch. Friction between the rollers 313 and 315 and the winch line, however, causes wear.

In addition to recording a fairlead motor speed variable, a "spool-down" variable will be measured and recorded as well. This variable relates to how long it takes the winch drum to come to a stop after the winch remote button is released. The fairlead needs to operate during this period so that the winch line is being managed during the spool-down time.

The fairlead contains gears 321, 323, 325, 327, and 329. These gears enable the motor 307 to rotate the rollers 313 and 315 in the correct direction to assist in spooling the line onto the drum or unspooling the line from the drum. The number of gears is necessary to ensure that the rollers rotate in a coordinated direction to compress the line and pull it through the fairlead.

Preferably, the fairlead includes a current sensor 317 that attaches to the wiring of the winch. The current sensor is a device to measure the current drawn by the motor. The current sensor 317 detects the direction the winch motor is rotating the winch drum. This information is then communicated to a microcontroller connected to the fairlead motor 307. The microcontroller controls the fairlead motor 307 and ensures that the fairlead motor rotates the rollers in coordination with the winch drum. The fairlead measures this current using a non-contact, open-loop current sensor. This sensor is installed over one of the winch wires that supply electrical power to the winch motor.

Figure 5:
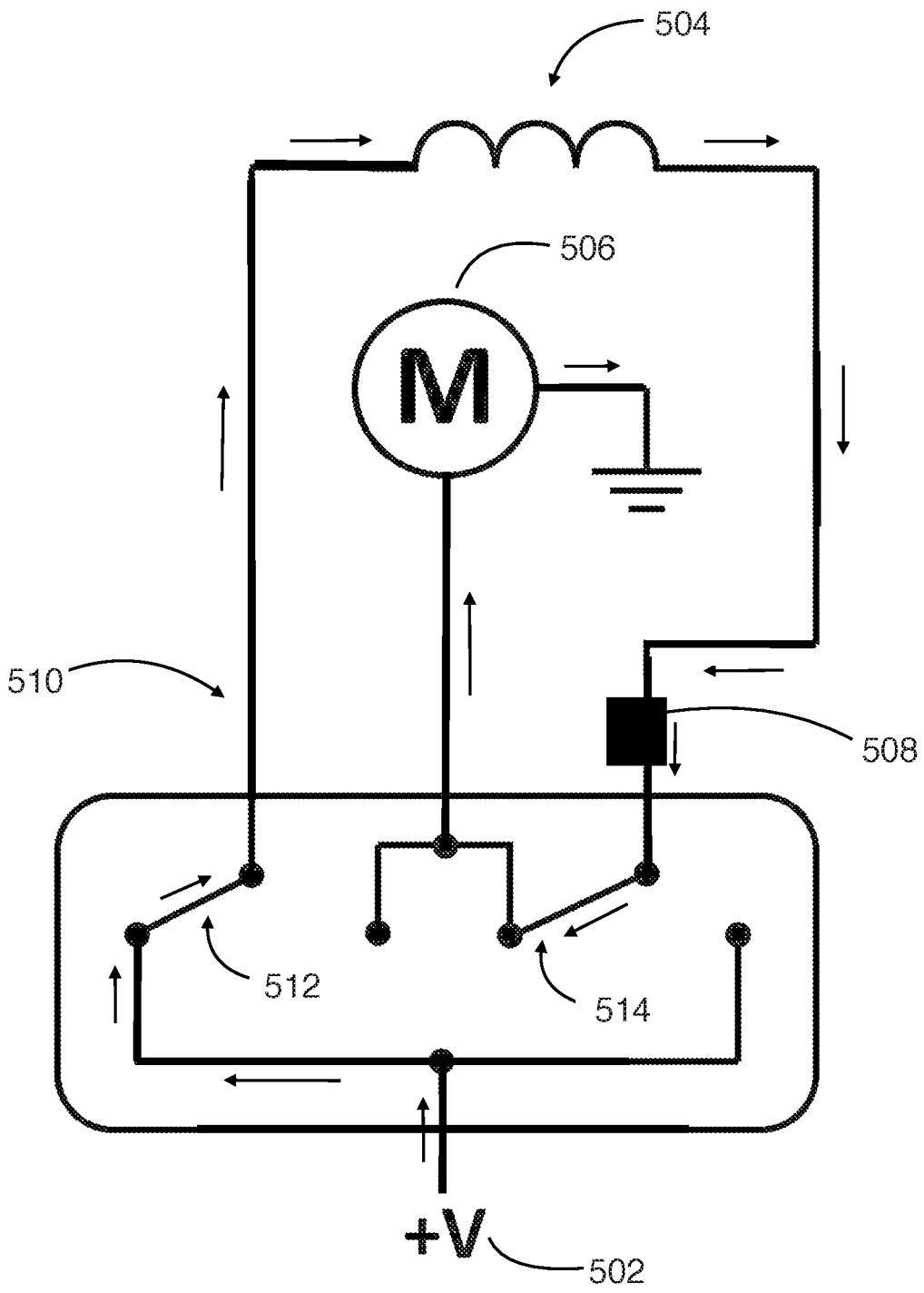
FIG. 5 is a current path diagram.
Figure 6:
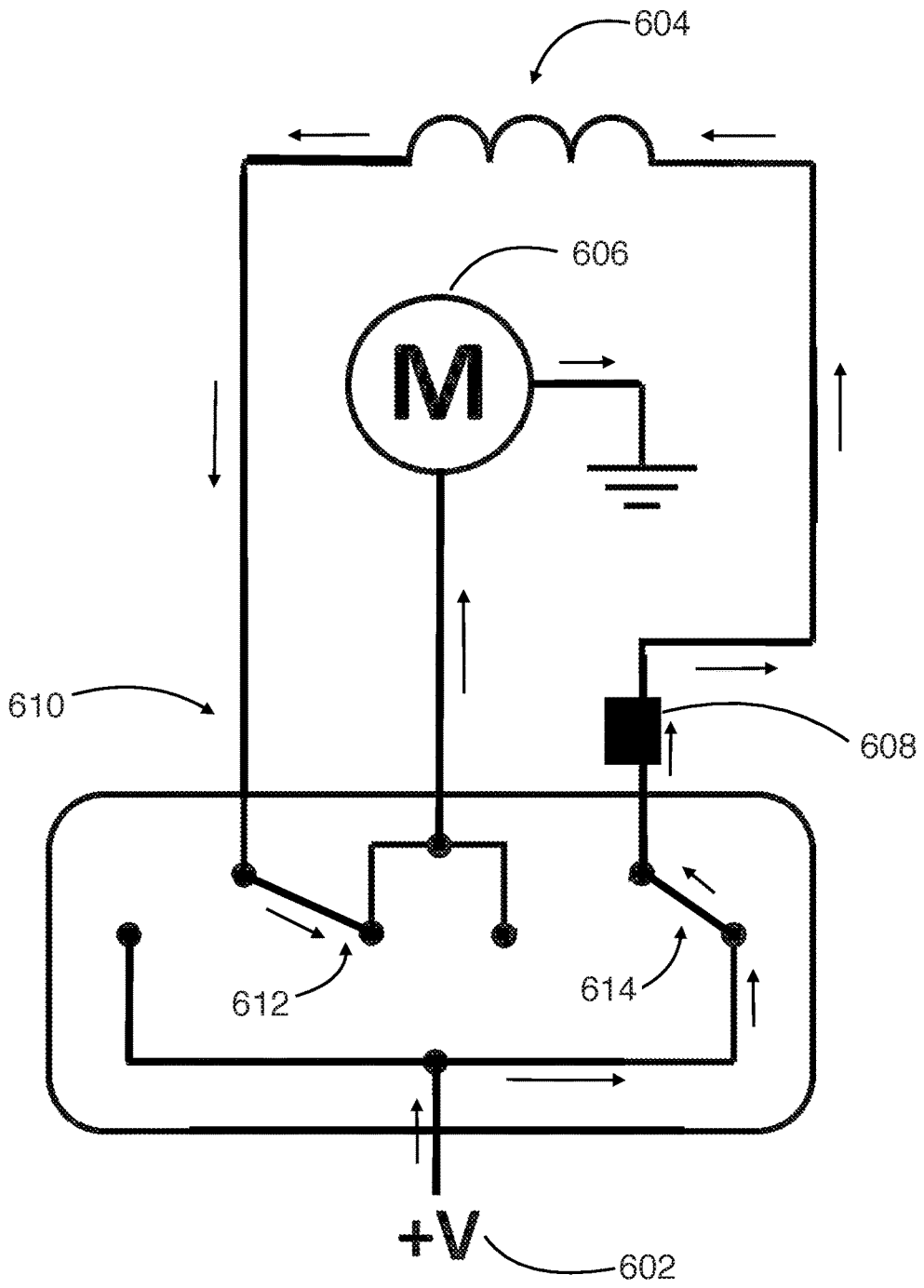
FIG. 6 is a current path diagram.

FIGS. 5 and 6 are circuit diagrams detailing where to place the current sensor to allow the fairlead to sense the direction and the amplitude of the current used by the winch. FIG. 5 illustrates the flow of current for a winch as the line is unspooled from the winch drum. FIG. 6 illustrates the flow of current for a winch as the line is spooled onto the winch drum. In FIG. 5 the current flows from the battery 502 through the circuit. The current continues through switch 512 to the stator windings 504. Current continues through the current sensor 508. Then through switch 514 to the motor windings. The current through the stator windings 504 creates an electromagnetic field that interacts with the electromagnetic field of the motor windings to rotate the motor.

In FIG. 6 the current flows from the battery 602 through the circuit. The current continues through switch 614 to the stator windings 604. Current continues through the current sensor 608. Then through switch 612 to the motor windings. The current through the stator windings 604 creates an electromagnetic field that interacts with the electromagnetic field of the motor windings to rotate the motor.

In FIG. 5 the current causes the line to be unspooled from the drum. As the current passes through the current sensor, it is traveling in one direction. For the purpose of this figure, it is passing down through the current sensor. The current sensor detects the direction the current is traveling. The sensor could be said to interpret this direction as a positive polarity. In FIG. 6 the current causes the motor to rotate so the line is spooled onto the drum. As the current passes through the current sensor, it is traveling in the opposite direction from the current in FIG. 5. For the purpose of this figure, it is passing up through the current sensor. The current sensor detects the direction the current is traveling. As the direction the current is traveling in FIG. 6 is opposite that of the direction the current is traveling in FIG. 5, the sensor could be said to interpret this direction as a negative polarity. Even though the polarity of the current is unchanged, the change in the current path changes the direction the current travels through the current sensor.

The current sensor could also be placed in another location on the circuit. For example, the current sensor could also be placed at location 510 or location 610.

The previous example illustrates the fairlead as it is used with a series-wound winch. The fairlead is configured to be used with many types of winches. For example, in another embodiment, a winch that uses a basic or traditional style DC motor with permanent magnets will reverse the electrical polarity to change the direction of the winch motor. The current sensor is placed on the wire carrying the current to the motor to monitor the change in polarity and thus the change in the direction of the winch motor. The current sensor communicates the change in polarity to the fairlead motor.

Figure 7:
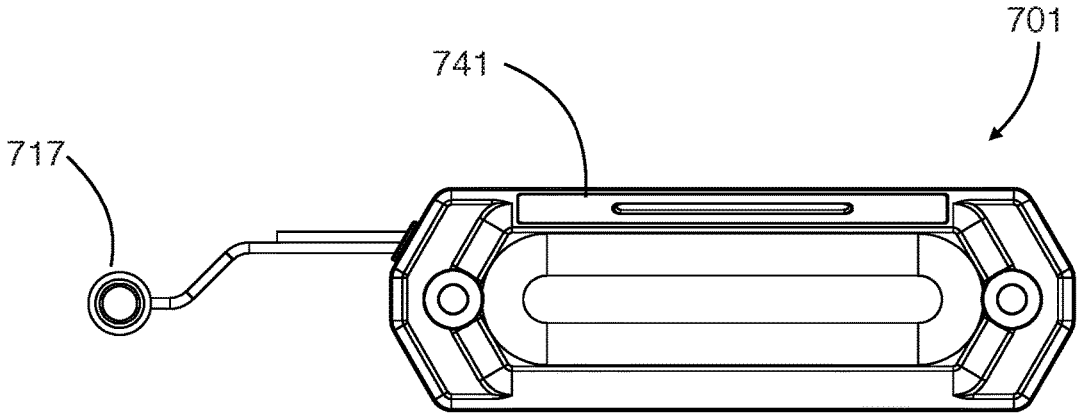
FIG. 7 is a front view of one embodiment of a fairlead.

FIG. 7 is a front view of a fairlead that visually indicates the load on a winch. The amount of current a winch draws from the battery is related to the amount of weight the winch is pulling. The heavier the weight, the more power the winch requires, the more current the winch will draw from the battery. The fairlead 701 measures this current using a non-contact, open-loop current sensor 717. This sensor is preferably installed over one of the winch wires that supply electrical power to the winch motor.

Figure 8:
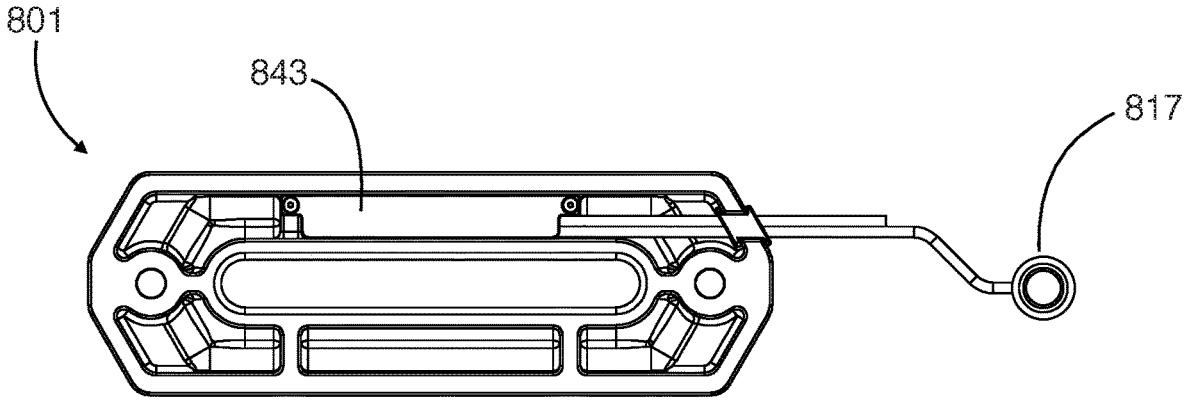
FIG. 8 is a rear view of one embodiment of a fairlead.

The fairlead's built-in electronics take the signal from the current sensor and output it to the load indicator 741. The load indicator is integrated into the fairlead. The load indicator includes an array of lights as can be seen in FIG. 8. Preferably, the array of lights in the load indicator contains twelve light emitting diodes (LEDs). Alternatively, the array of lights in the load indicator contains as few as 3 LEDs or as many as 20 LEDs. While LEDs are the preferred lights for the load bar, other lights can be used. The LEDs are sequentially lit up from left to right as the load increases. The colors of the light emitting diodes (LEDs) also change with increasing load, for example changing from green to yellow to orange to red.

FIG. 8 is a rear view of a fairlead that visually indicates the load on a winch. The amount of current a winch draws is related to the amount of weight the winch is pulling. The heavier the weight, the more power the winch requires, the more current the winch will draw from the battery. The fairlead 801 measures this current using a non-contact, open-loop current sensor 817. This sensor is installed over one of the winch wires that supply electrical power to the winch motor.

The fairlead's built-in electronics 843 take the signal from the current sensor and output it to the load indicator. The built-in electronics act in concert with the current sensor as a sensor for determining a load on the winch. The built-in electronics preferably include a controller and a printed circuit board (PCB). The controller and LEDs are preferably incorporated in the PCB.

Different makes and models of winches draw different amounts of current at their maximum rated capacity. Having a user calibrate the fairlead to their style of winch would be very difficult. Most winches that would utilize this size fairlead (trucks/jeeps) draw between 400-500 amps when at maximum capacity. Since the load indicator does not display a high-resolution indicator of an exact instantaneous load, it is programmed to display a maximum load at an average of 450 amps. This will give users a "ballpark" idea of how loaded their winch is.

Alternatively, the load indicator can be calibrated by the user to indicate the specific load on their winch. The app, shown in FIG. 10, adapted to function with a remote-control device includes a calibration setting. When calibrated by the user to the specific winch used with the load indicator, a much more accurate indication of the load will be provided by the load indicator. In some embodiments, the indicator will be part of a fairlead that is itself part of a winch. When the complete winch is used together the load indicator will be calibrated for the winch. Having the load indicator integrated into a fairlead that is integrated into a winch allows much more control over the functions of the winch. Including, design and production specifics regarding the motors in the winch and the fairlead. This control enables greater precision in the programming of the load indicator. Therefore, a complete winch with fairlead and load indicator will be more accurate. Another alternative embodiment includes the load indicator and a winch without the fairlead.

By coordinating the actions of the fairlead to the winch, the fairlead is controlled along with the winch in many embodiments. In some embodiments, however, a remote control gives users greater control over the functions of the fairlead. The remote control is a stand-alone device in some embodiments. In other embodiments, the remote control is an app running on a personal communication device, such as a smartphone, tablet, or laptop computer. The app for a personal communication device includes a user interface. The user interface is able to provide additional information to the user, such as load on the winch and whether the winch is spooling or unspooling.

Figure 9:
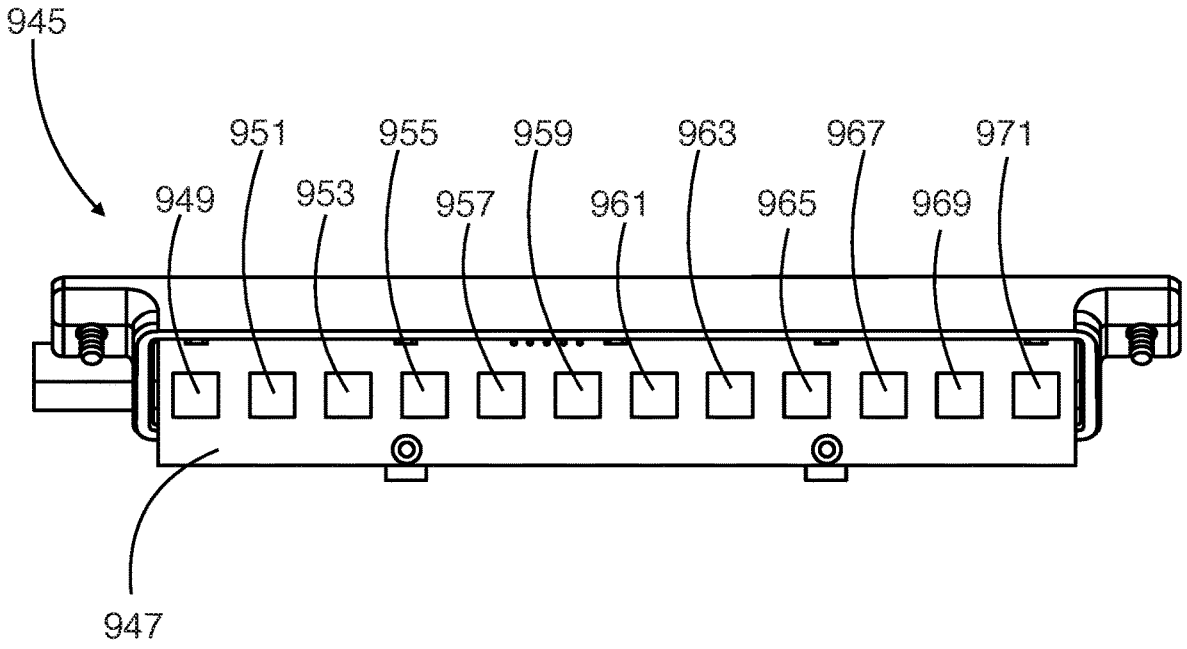
FIG. 9 is a view of a light array.

The light array 945 of the load indicator is shown in FIG. 9 including the light array. The lights in the array are connected to a printed circuit board (PCB) 947 in one embodiment of the fairlead. The current sensor is connected to the PCB 947. As the current drawn by the winch increases, which indicates an increase in the load on the winch, the lights 949, 949, 951, 953, 955, 957, 959, 961, 963, 965, 967, 969, and 971 in the array light up and change color. In one embodiment, when the winch is turned on, one of the lights 949 in the array will be in an on state. The one light indicates that the winch is on, and there is no load on the winch. As the load increases, the number of lights proportionate to the percentage of the maximum load in the array turn on. When all the lights 949-971 in the array are on the winch has reached the maximum load. The number of lights 949 on in the array is an indication of how much of the winch's maximum capacity is in use by the winch. When half of the lights or lights 949, 951, 953, 955, 957 and 959 are on, half of the winch's maximum capacity is in use.

Alternatively, in another embodiment, when the winch is turned on all of the lights 949-971 in the array are in an on state, and they are all green in color. As the current drawn by the winch increases the lights in the array change color according to the amount of current drawn. Preferably, the lights change in color from green to yellow, to orange to red. Changing the color of the lights in the array allows a user to quickly determine how much of a winch's maximum capacity is being used. When the lights are all yellow approximately one-third of the maximum capacity is being used. When the lights are all orange approximately two-thirds of the maximum capacity is being used. Finally, when the lights are all red the maximum capacity of the winch is being used.

Light emitting diodes (LEDs) are the preferred lights for the array. LEDs are capable of being programmed to change color. There are multiple options for the number of lights in the array. Preferably, the light array contains between 3 and 20 lights. More preferably, the number of lights in the array is between 6 and 15. Most preferably, the number of lights in the array is 12.

In an alternative embodiment, the load indicator is attached to the winch as part of the control switch. For example, some winches have control switches that are wired to the inside of the vehicle they are placed on. The load indicator in this example is attached next to the winch control switches inside the vehicle.

In some embodiments, the winch and the fairlead are controlled by wires connected to the winch and fairlead. In other embodiments, the controls for the winch and the fairlead are located on the winch and the fairlead. In the preferred embodiment, the winch and fairlead are controlled through a remote-control device.

Figure 10:
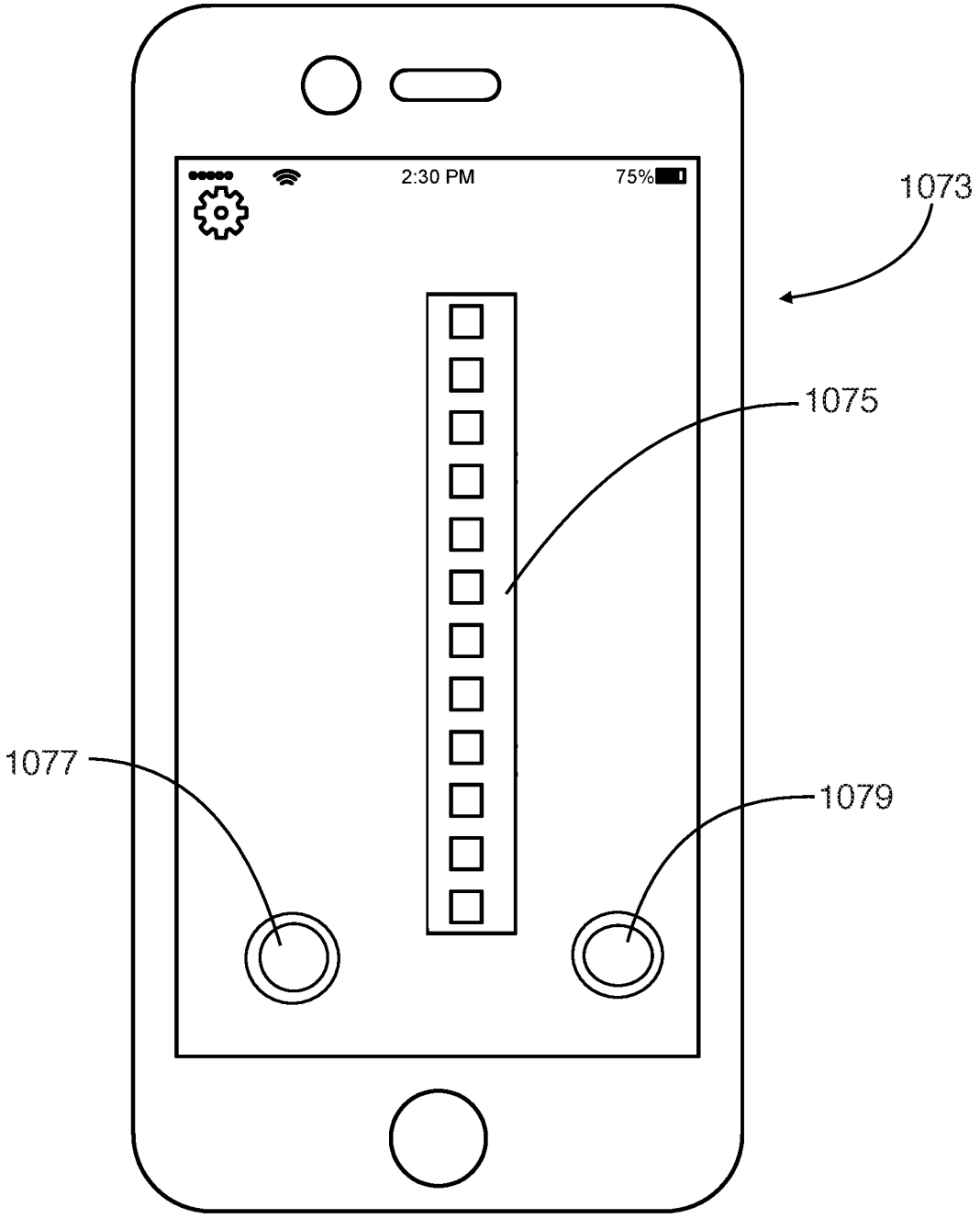
FIG. 10 is a view of a remote-control device.

The remote-control device is in one embodiment a stand-alone device which only connects to and controls the winch and fairlead. Preferably, as depicted in FIG. 10, the remote-control device is a personal control device such as a smartphone. The smartphone 1073 is adapted to communicate with and control the winch and fairlead. Generally, this is done through an app downloaded on the smartphone. The app will display a user interface on the smartphone 1073. For example, the app includes a representation of the load indicator 1075. The graphically represented load indicator 1075 displays the same load indications as the physical load indicator located on the fairlead or in the vehicle. The lights on the graphically represented load indicator 1075 will also change in color and in lights on to indicate the load on the winch.

Included in the app running on the smartphone 1073 is the ability to control the actions of the winch and fairlead. For example, to unspool the line off the winch the user presses virtual button 1077. To spool the line onto the winch the user presses virtual button 1079. The app is also adapted to keep track of statistics regarding the winch and fairlead. The winch will record and store when the winch was last used. Additionally, the app will record other information such as; how much of the line was unspooled, the average load on the winch, the maximum load on the winch, how fast the line spooled, and how fast the line unspooled.

The app and remote-control device are in some embodiments adapted to enable alarms to notify the user when certain thresholds of the current draw are reached. For example, a user could select an alert to notify the user when the current draw reaches 75%. In another embodiment, the remote-control device is used to program the winch to stop spooling the line in when the current draw reaches a certain threshold. The automatic stopping of the winch at a certain current draw would be more accurate and less likely to damage the winch from reaching the maximum current draw, which can result in motor damage. For example, the user could decide that at 95% of maximum current draw the winch will stop spooling the line in. The user would then select 95% as the current draw for stopping the winch from spooling the line in.

In some embodiments, the fairlead is a mechanism to add to an existing winch. In other embodiments, the fairlead is incorporated into a winch.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. A fairlead for use with a winch comprising:
a self-reversing screw;
a motor for driving the self-reversing screw;
a guide comprising a guide nut and a first guide side and a second guide side;
wherein, the guide is driven by the self-reversing screw;
wherein as a line is spooled onto a winch drum the guide directs the line onto the winch drum; and
wherein, the first guide side and the second guide side are detachable from the guide nut and from each other during spooling by a lateral force by the line on either the first guide side or the second guide side.

2. The invention of claim 1, wherein the guide nut and the first guide side and the second guide side are attached together by magnets.

3. The invention of claim 2, wherein the first or the second guide side will detach from the guide nut and the other guide side when there is lateral force on either the first guide side or the second guide side.

4. The invention of claim 3, further comprising at least one guide rail with magnets at either end.

5. The invention of claim 4, wherein the detached guide half is secured at the end of the guide rail until there is no longer a lateral force on the guide side.

6. The invention of claim 5, wherein the fairlead is integrated into a winch.

7. A fairlead for use with a winch comprising:
a first and second roller adapted to aid in spooling or unspooling a line;
a self-reversing screw;
a motor for driving the self-reversing screw and at least the first roller;
a sensor for determining a load on the winch and whether a winch drum is spooling or unspooling the line;
a device to measure the current drawn by the motor;
a controller connected to the motor and in communication with the sensor and the device;
multiple lights in an array, each of which can be changed by the controller from one appearance to another;
a guide comprising a guide nut and a first guide side and a second guide side;
wherein, the sensor determines whether the winch drum is spooling or unspooling the line;
wherein; the controller is configured to direct the motor so that at least the first roller assists in spooling or unspooling the line in coordination with the winch drum;
wherein, in response to a signal from the sensor, the controller is configured to change the appearance of lights in the array, with the number of lights with a changed appearance being proportional to the load sensed by the sensor;
wherein the controller is configured to direct the fairlead motor to drive at least the first roller so that the fairlead motor maintains a target current draw;
wherein, the guide is driven by the self-reversing screw;
wherein as the line is coiled onto the winch drum the guide directs the line onto the winch drum; and
wherein, the first guide side and second guide side are detachable from the guide nut and from each other during spooling by a lateral force by the line on either the first guide side or the second guide side.

8. The invention of claim 7, wherein the sensor determines whether the winch drum is spooling or unspooling the line based on the direction of the current.

9. The invention of claim 7, wherein the array begins with one light in an on state when there is no load on the winch and increases the number of lights in an on state proportional to the load on the winch.

10. The invention of claim 7, wherein the fairlead is adapted to communicate with and receive commands from a remote-control device.

11. A winch comprising:
a winch motor;
a winch drum for spooling and unspooling a line;
a fairlead comprising;
a first and second roller adapted to aid in spooling or unspooling the line;
a self-reversing screw;
a motor for driving the self-reversing screw and at least the first roller;
a sensor for determining a load on the winch and whether the winch drum is spooling or unspooling the line;
a device to measure the current drawn by the motor;
a controller connected to the motor and in communication with the sensor and the device;
multiple lights in an array, each of which can be changed by the controller from one appearance to another;
a guide comprising a guide nut and a first guide side and a second guide side;
wherein, the sensor determines whether the winch drum is spooling or unspooling the line;
wherein; the controller is configured to direct the motor so that at least the first roller assists in spooling or unspooling the line in coordination with the winch drum;
wherein, in response to a signal from the sensor, the controller is configured to change the appearance of lights in the array, with the number of lights with a changed appearance being proportional to the load sensed by the sensor;
wherein the controller is configured to direct fairlead motor to drive at least the first roller so that the fairlead motor maintains a target current draw;
wherein, the guide is driven by the self-reversing screw;
wherein as the line is coiled onto the winch drum the guide directs the line onto the winch drum; and
wherein, the first guide side and second guide side are detachable from the guide nut and from each other during spooling by a lateral force by the line on either the first guide side or the second guide side.

12. The invention of claim 11, wherein the guide nut and the first guide side and the second guide side are attached together by magnets.

13. The invention of claim 12, wherein the first or the second guide side will detach from the guide nut and the other guide side when there is lateral force on either the first guide side or the second guide side.

14. The invention of claim 11, wherein the sensor determines whether the winch drum is spooling or unspooling the line based on the direction of the current.

15. The invention of claim 11, wherein the array begins with one light in an on state when there is no load on the winch and increases the number of lights in an on state proportional to the load on the winch.

16. The invention of claim 11, wherein the array begins with all the lights showing one color when there is no load on the winch;

wherein, as a load is applied to the winch, one light first changes to another color; and wherein as the load is increased, more lights change to the other color according to the load on the winch.

17. The invention of claim 11, wherein the winch is adapted to communicate with and receive commands from a remote-control device.

18. The invention of claim 17, wherein the remote-control device is adapted to display an alert at a user selected percentage of a maximum load on the winch.

19. The invention of claim 17, wherein the remote-control device is adapted to issue a command to the winch to stop spooling the line in when the current draw reaches a user-selected percentage of a maximum current draw.

20. The invention of claim 17, wherein a user is able to adjust the target current draw with the remote-control device.

* * * * *